US009797621B2

(12) United States Patent
Parzick

(10) Patent No.: US 9,797,621 B2
(45) Date of Patent: Oct. 24, 2017

(54) PORTABLE DEVICE TO IMPROVE THE CONNECTION OF PLASTIC TUBING TO FITTINGS

(75) Inventor: Charles Parzick, Hemet, CA (US)

(73) Assignee: Charles Parzick, Hemet, CA (US)

( * ) Notice: Subject to any disclaimer, the term of this patent is extended or adjusted under 35 U.S.C. 154(b) by 953 days.

(21) Appl. No.: 13/540,228

(22) Filed: Jul. 2, 2012

(65) Prior Publication Data

US 2014/0001172 A1 Jan. 2, 2014

(51) Int. Cl.

| | |
|---|---|
| ***F24H 1/00*** | (2006.01) |
| ***A45F 5/00*** | (2006.01) |
| ***F24H 1/06*** | (2006.01) |

(52) U.S. Cl.

CPC ..... *F24H 1/06* (2013.01); *F24H 2240/01* (2013.01)

(58) Field of Classification Search

CPC ..... H05B 1/023; H05B 1/0244; H05B 6/14; B01L 7/00; F24C 1/16; F24C 7/006; F24C 15/26; F24C 15/2078

USPC ..... 219/211–219, 386, 387, 527, 529, 531, 219/534; 156/158, 294, 296, 304.2, 156/304.3, 304.6, 359, 499, 503; 392/339, 441, 444–448

See application file for complete search history.

(56) References Cited

U.S. PATENT DOCUMENTS

| | | | | |
|---|---|---|---|---|
| 3,432,641 | A * | 3/1969 | Welke | 219/433 |
| 3,601,581 | A * | 8/1971 | Cone | 219/386 |
| 3,957,032 | A * | 5/1976 | Jelesko | 126/271.2 R |
| 5,208,896 | A * | 5/1993 | Katayev | 392/444 |
| 5,259,418 | A | 11/1993 | Hamrick | |
| 5,540,341 | A * | 7/1996 | Holley et al. | 215/11.4 |
| 5,573,280 | A | 11/1996 | Salter et al. | |
| 6,394,148 | B1 | 5/2002 | Clarke | |
| 6,737,091 | B1 * | 5/2004 | Littell, II | 426/117 |
| 7,211,776 | B2 | 5/2007 | Jensen | |
| 7,326,897 | B2 | 2/2008 | Jensen | |
| 7,389,897 | B2 * | 6/2008 | Pistiolis et al. | 224/158 |
| 8,045,848 | B2 * | 10/2011 | Wortley | 392/444 |
| 8,459,058 | B2 * | 6/2013 | Mogil | 62/457.7 |
| 2004/0043041 | A1 * | 3/2004 | Baker et al. | 424/400 |
| 2004/0140304 | A1 * | 7/2004 | Leyendecker | 219/386 |
| 2005/0203450 | A1 * | 9/2005 | Shippert | 602/7 |
| 2008/0034568 | A1 * | 2/2008 | Bouchard | 29/428 |
| 2008/0251063 | A1 * | 10/2008 | Palena et al. | 126/263.09 |
| 2012/0012627 | A1 * | 1/2012 | Hess | 224/576 |
| 2012/0061376 | A1 * | 3/2012 | McBean et al. | 219/430 |

FOREIGN PATENT DOCUMENTS

| | | | |
|---|---|---|---|
| JP | 01261509 A | * | 10/1989 |
| JP | 02291890 A | * | 12/1990 |
| JP | 2000343871 A | * | 12/2000 |

* cited by examiner

*Primary Examiner* — Dana Ross

*Assistant Examiner* — Kuangyue Chen

(74) *Attorney, Agent, or Firm* — Convergent Law Group LLP

(57) ABSTRACT

The present invention relates generally to a portable device for heating the ends of plastic tubing to enlarge the diameter and increase the flexibility of the tubing to more easily connect with various fittings.

12 Claims, 1 Drawing Sheet

PORTABLE DEVICE TO IMPROVE THE CONNECTION OF PLASTIC TUBING TO FITTINGS

STATEMENT REGARDING FEDERALLY SPONSORED RESEARCH OR DEVELOPMENT

This invention was made without the support of the Federal Government.

FIELD OF THE INVENTION

The present invention relates generally to a portable device for heating the ends of plastic tubing to temporarily enlarge the diameter and increase the flexibility of the tubing to more easily connect with various fittings.

BACKGROUND OF THE INVENTION

In the following discussion, certain devices and methods will be described for background and introductory purposes. Nothing contained herein is to be construed as an "admission" of prior art. Applicant expressly reserves the right to demonstrate, where appropriate, that the articles and methods referenced herein do not constitute prior art under the applicable statutory provisions.

Methods in many, varied industries utilize plastic tubing for transporting liquids, with the plastic tubing connected to various fittings to allow, e.g., two lengths of tubing to be connected, or for one length of tubing to be connected to a valve or spigot. In many instances, the fitting comprises an elongated cylindrically-shaped body with at least one frustoconically-shaped tail portion that tapers from a larger size at the body of the fitting to a smaller-sized end over which the tubing is slid. The contact between the tubing and the tapered end of the fitting must be tight for the connection to be leak-proof.

In many applications, the slide-on connection between the tubing and the fitting is impeded by the diameter of the tubing and its lack of flexibility. One specific example is in the harvesting of maple syrup, where sap is harvested from a maple tree forest and a polyethylene tubing system is utilized to transfer sap from the tree to a container. The current method requires a scissor-like, hand-held tool with tubing clamps plus a significant amount of force to make the semi-rigid tubing slide over the fitting and complete a usable connection.

What has not been available until now is a portable device for heating the tubing ends to temporarily increase the diameter and flexibility of the tubing so desired connections can be more easily made by hand and tool free. The present invention meets this unmet need.

SUMMARY OF THE INVENTION

This Summary is provided to introduce a selection of concepts in a simplified form that are further described below in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the following written Detailed Description including those aspects illustrated in the accompanying drawings and defined in the appended claims.

The present invention relates generally to a portable device for heating the ends of plastic tubing so that the diameter of the heated portion increases slightly and the tubing becomes more flexible. The tubing thus heated requires significantly less effort to slide over a fitting in the process of making a connection. While cooling, the tubing diameter tends to contract back to its original dimension, compressing around the fitting and making a strong, leak-proof connection. The portability particularly is desired in locations not served by electricity.

In some embodiments, the present invention provides a portable device for heating tubing comprising: a portable device for heating tubing comprising: a power source; a thermostatically-controlled heating chamber connected to the power source, wherein the heating chamber holds and heats fluid to a working temperature; and a carrier for carrying the power source and heating chamber. In some aspects, the power source comprises means to adjust the temperature. In some aspects, the carrier is belt-mounted, and in some aspects the carrier comprises a shoulder strap. In some aspects, the power supply and heating chamber are secured in the carrier so that they remain securely in place while being carried and in operation, and in some aspects the carrier is designed to be free standing in an upright position. In preferred aspects of this embodiment of the invention, the heating chamber further comprises a leak-resistant cap, and in preferred aspects, the heating chamber is insulated to resist heat loss.

In some aspects of this embodiment of the invention the carrier further comprises a vessel containing the fluid that is used in the heating chamber, where the fluid has a boiling point above the desired temperature, and preferably is non-toxic to humans and inhibits microbe growth. In some aspects, the heating chamber is configured to heat tubing one inch or less in diameter, and in some aspects, the heating chamber is configured to heat tubing one-half inch or less in diameter. In some aspects, the heating chamber is configured to heat a length of the tubing substantially equal to the length of the receptor portion of the fitting.

In yet another embodiment, the invention provides a portable device for reshaping tubing comprising: a power source; a thermostatically-controlled, fuse-protected insulated heating chamber for holding fluid configured to heat tubing to a desired length; and a carrier for carrying the power source and heating chamber.

DESCRIPTION OF THE FIGURES

So that the manner in which the features, advantages and objects of the present invention described herein are attained and can be understood in detail, a more particular description may be had by reference to the embodiment illustrated in the appended Figure. It is to be noted, however, that the appended Figure illustrates only one embodiment of the invention, and therefore is not to be limiting to its scope, for the present invention may admit to other equally effective embodiments and industrial applications.

DETAILED DESCRIPTION OF THE INVENTION

In the following description, numerous specific details are set forth to provide a more thorough understanding of the present invention. However, it will be apparent to one of skill in the art that the present invention may be practiced without one or more of these specific details. In other instances, well-known features and procedures well known to those skilled in the art have not been described in order to avoid obscuring the invention.

The present invention relates to a portable device for heating the end portion of plastic tubing to temporarily increase the diameter and flexibility of the tubing so that the tubing more readily slides onto fittings, and then contracts as it cools to provide a tight and secure coupling. The portability particularly is desired in locations not served by electricity such as outdoor environments. The portability and wearability of the device is particularly desired when hands-free work combined with mobility is important.

Figure 1:
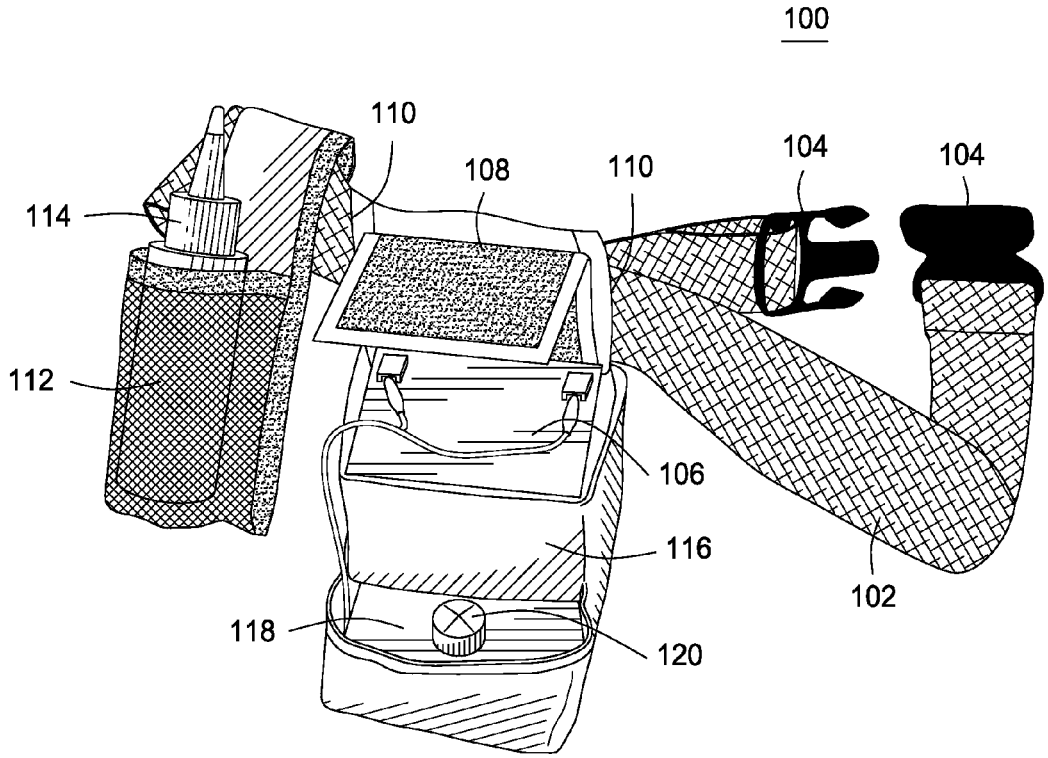
FIG. 1 is an illustration showing the device of the present invention according to one embodiment of the present invention.
Figure 2:
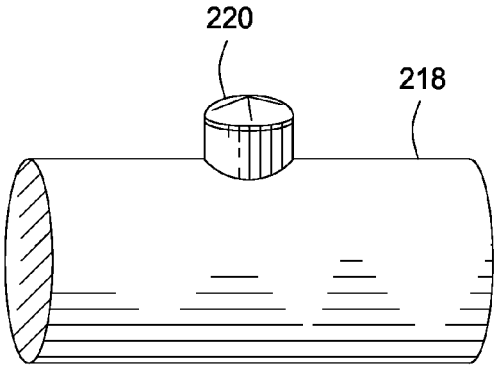
FIG. 2 is an illustration of the heating chamber portion of the device.

FIG. 1 is an illustration showing a device 100 of the present invention according to one embodiment of the present invention. Device 100 as shown comprises a belt 102, buckle 104, power source 106, a cover 108 for power source 106, attachments 110 that attach the pouch or holder 112 of fluid bottle 114 and carrier 116 (holding power source 106 and heating chamber 118 where the tubing (not shown) is inserted and heated) to belt 102, and a cap 120 for heating chamber 118. FIG. 2 is an illustration of the heating chamber portion 218 of the device, showing the leak-resistant cap 220.

The tubing that may be heated by the device may be any type of plastic or polymer tubing, where heating will affect both the diameter and flexibility of the tubing sufficiently to enhance the connection process. The type of tubing used depends on the particular industry and application and is selected by its particular properties, including the amount of flexibility desired, the temperature to which it must be heated to affect connection to a fitting, and cost.

The material used for the carrier housing the power supply and heating chamber in preferred embodiments is any durable material that resists wear, stands up well to the elements and provides support for the power supply and chamber, and in more preferred embodiments, the material is water-resistant or waterproof, including materials such as Kevlar®, nylon, polyurethane, or natural or synthetic fabrics that are laminated to or coated with a waterproofing material such as rubber, polyvinyl chloride, polyurethane, silicone elastomer, fluoropolymers, and wax. If a belt or strap is employed, the belt or strap may be made out of any common material such as nylon or the waterproof fabrics listed above. As an alternative to a belt or strap, the power supply and heating chamber may be carried in a tote bag or backpack, although the belt and strap embodiments allow one to have the heating chamber at the ready in a "hands free" configuration.

The power source used can be any power source that is portable (the lighter the better) and of sufficient power to rapidly heat and keep heated the fluid in the heating chamber for from a few to preferably several hours. Preferably the power supply is rechargeable and in some embodiments the amount of power supplied may be adjustable. Power sources of particular use include rechargeable, sealed batteries used in the collection, storage and release of solar and wind-generated electricity; e.g., sealed lead acid and lithium batteries.

The heating chamber may be made of any material that is preferably highly conductive of heat and is resistant to corrosion by the fluid(s) used to heat the tubing. The heating chamber may comprise several materials and layers. For example, the fluid reservoir of the heating chamber may be made of copper with the components (heating tape, thermostat and fuse) held in place by a high-temperature silicone-based tape. The fluid reservoir is then covered with a high-temperature insulation layer such as that used to insulate copper pipe such as Armacell™. The dimensions of the heating chamber depend on the size of the tubing used. The fluid reservoir must have an opening adequate to accommodate the tubing and hold enough fluid to thoroughly and uniformly heat the tubing. Additionally, the reservoir will have a depth sufficient to accommodate the length of tubing desired to be heated (e.g., a length substantially equal to the length of the receptor portion of the fitting). Typically the tubing will have a diameter of less than three inches, less than two inches, less than one inch, and more typically will have a diameter of about a half inch or less.

Fluids used for heating the tubing include any fluid that has a boiling point higher and preferably significantly higher than the temperature needed to reshape the tubing selected, and, in the context of the food or medical industries, is non-toxic and, preferably, resists microbial growth. One preferred liquid for use with the polyethylene tubing is glycerol, a naturally-occurring compound often used as a food additive. The boiling point of glycerol (290° C.) is well above the ideal connecting temperature for polyethylene tubing (approximately 80-110° C.). Glycerol leaves very little residue on the tubing after heating and has natural bactericidal and bacteriostatic properties.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims. In the claims that follow, unless the term "means" is used, none of the features or elements recited therein should be construed as means-plus-function limitations pursuant to 35 U.S.C. §112, ¶6.

I claim:

1. A wearable, portable device for heating plastic or polymer tubing comprising: a power source; a thermostatically-controlled heating chamber connected to the power source, wherein the heating chamber comprises an opening adequate to accommodate plastic or polymer tubing of a diameter of less than 3 inches, and wherein the heating chamber holds and heats fluid to a working temperature sufficient to reshape the plastic or polymer tubing; and a carrier to allow a human subject to carry the power source and the heating chamber.

2. The device of claim 1, wherein the power source is re-chargeable.

3. The device of claim 1, wherein the carrier is belt-mounted.

4. The device of claim 1, wherein the carrier comprises a shoulder strap.

5. The device of claim 1, wherein the power source and the heating chamber are secured in the carrier.

6. The device of claim 1, wherein the heating chamber further comprises a leak-resistant cap.

7. The device of claim 1, wherein the carrier is capable of free standing.

8. The device of claim 1, wherein the heating chamber is thermally insulated.

9. The device of claim 1, wherein the fluid contained in the heating chamber has a boiling point above the working temperature, is non-toxic to humans and inhibits microbe growth.

10. The device of claim 1, wherein the heating chamber is configured to heat tubing one inch or less in diameter.

11. The device of claim 9, wherein the heating chamber is configured to heat tubing one-half inch or less in diameter.

12. A wearable, portable device for reshaping plastic or polymer tubing of a diameter of less than 3 inches comprising: a power source; a thermostatically-controlled, fuse-protected thermally insulated heating chamber comprising an opening adequate to accommodate the plastic or polymer tubing of a diameter of less than 3 inches, wherein the heating chamber is adapted to hold fluid configured to heat the plastic or polymer tubing to a desired temperature sufficient to reshape the plastic or polymer tubing; and a carrier to allow a human subject to carry the power source and the heating chamber.

* * * * *